United States Patent [19]

DeCarolis

[11] 4,377,959

[45] Mar. 29, 1983

[54] MITRE BOX WITH CORNER CLAMPS

[75] Inventor: Joseph P. DeCarolis, Bristol, Conn.

[73] Assignee: The Stanley Works, New Britain, Conn.

[21] Appl. No.: 255,309

[22] Filed: Apr. 17, 1981

[51] Int. Cl.[3] ..... B27G 5/02

[52] U.S. Cl. ..... 83/762; 269/41; 269/295

[58] Field of Search ..... 269/41, 295, 303, 302.1; 83/761, 762, 763, 764, 765, 581, 452–454

[56] References Cited

U.S. PATENT DOCUMENTS

| | | | |
|---|---|---|---|
| 415,637 | 11/1889 | Haueisen . | |
| 505,024 | 12/1893 | Brandon . | |
| 565,652 | 8/1896 | Walter et al. . | |
| 960,159 | 5/1910 | Dipworth . | |
| 1,574,663 | 2/1926 | Leske, Jr. . | |
| 1,663,247 | 3/1928 | Edwards et al. . | |
| 2,220,794 | 11/1940 | Pearce . | |
| 2,708,466 | 5/1955 | Stoll . | |
| 2,908,300 | 10/1959 | Hahn . | |
| 2,941,557 | 6/1960 | Baprowski . | |
| 3,072,396 | 1/1963 | McBurney . | |
| 3,935,779 | 2/1976 | Hildebrandt et al. | 83/762 |
| 4,009,857 | 3/1977 | Delmas | 269/302.1 |
| 4,023,787 | 5/1977 | Violette . | |
| 4,056,030 | 11/1977 | Hahn . | |
| 4,157,819 | 6/1979 | Meyer | 269/303 |

*Primary Examiner*—Robert C. Watson

[57] ABSTRACT

A mitre box includes a base member upon which is detachably secured a corner clamp providing a pair of movable jaw members movable at right angles to each other and relative to cooperating fixed clamp faces on opposite sides of a guide channel therein. The base member has a work support surface which is aligned with the guide channel and coplanar with the support surfaces of the corner clamp. Cooperating locating means are provided on the base member and corner clamp to position the members in predetermined alignment, and releasable fastening means secure the two members in assembly. Also included are a pair of guide posts upon which is slidably carried saw guide means to position an associated saw in alignment with the guide channel in the corner clamp.

10 Claims, 9 Drawing Figures

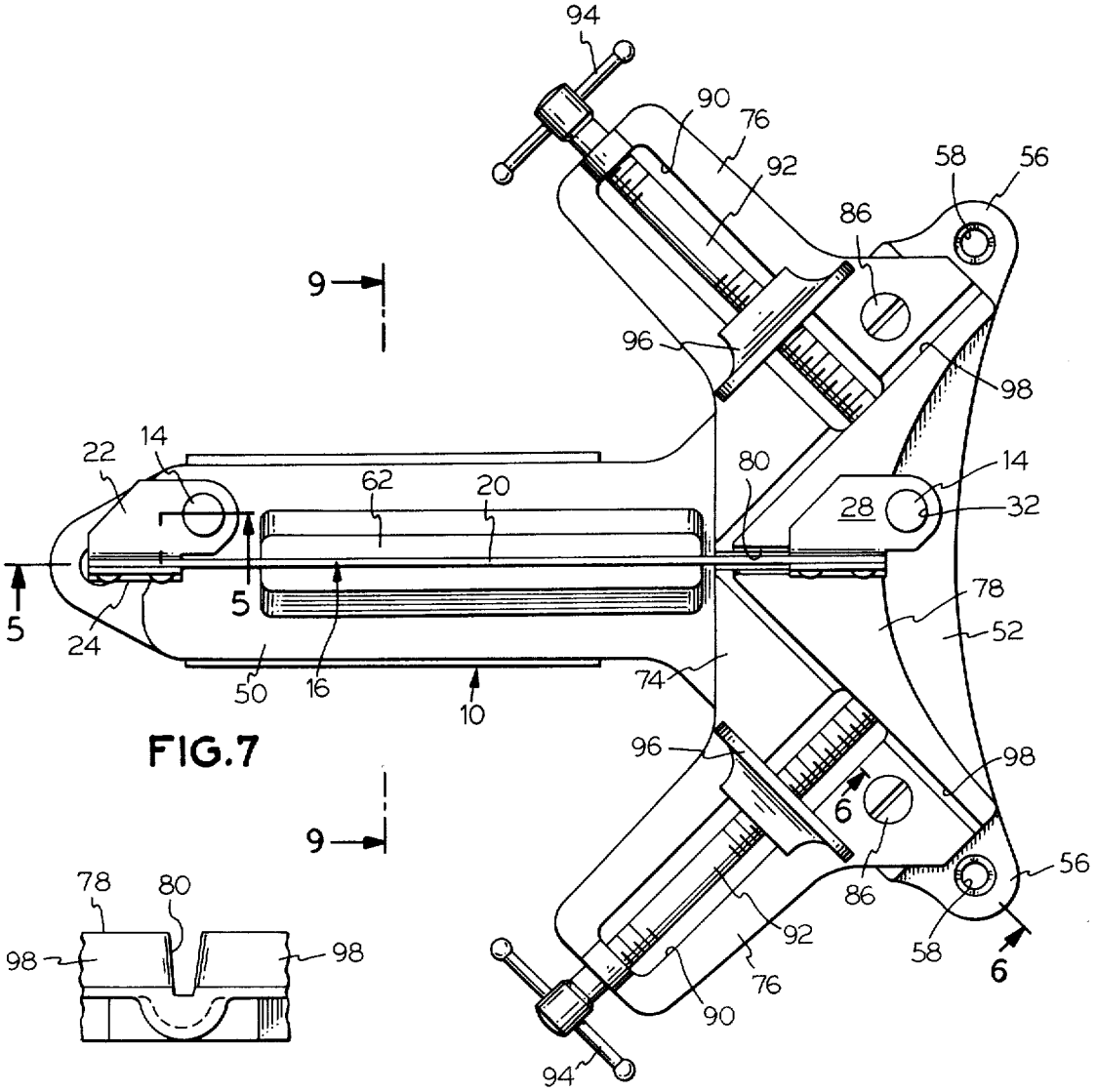
FIG. 7
FIG. 8
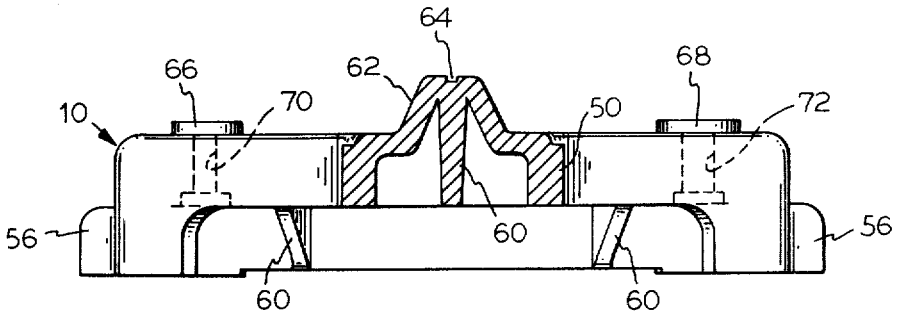
FIG. 9

MITRE BOX WITH CORNER CLAMPS

BACKGROUND OF THE INVENTION

Mitre boxes are widely employed for cutting the ends of workpieces to desire angular configurations and conventionally employ some guide means to orient the sawblade in the desired orientation relative to the workpiece. Some of the devices that are used provide a linear guide surface against which the workpiece is held by the user and have vertically extending guide slots in the guide surface and an opposed element to receive and guide the saw in the desired angular orientation. Other devices provide pivotable saw guide elements to orient the saw in the desired angular relationship to the workpiece. Some mitre boxes are specialized and used only for generating 45° angle cuts which will provide right angles when assembled.

Corner clamps are also widely employed to hold the cut workpieces in the desired right angular relationship while the adhesive applied to their mating surfaces cures to produce the desired bond. Thus, a workman will frequently require both a mitre box and some number of corner clamps to produce a frame or the like.

It is an object of the present invention to provide a mitre box which includes a removable corner clamp which is used to permit the cutting of the workpiece to the desired 45° angle and then may be used to hold the cooperating workpieces in assembly during the assembly operation.

It is also an object to provide such a mitre box in which the corner clamp may be readily removed for separate assembly operations when desired.

Another object is to provide such a mitre box which may be readily fabricated and readily assembled from components which are relatively inexpensive and which will provide relatively long life.

SUMMARY OF THE INVENTION

It has now been found that the foregoing and related objects and advantages may be readily attained in a mitre box including a base member having an upper surface with a work support portion and a clamp mounting portion, and a corner clamp which is mounted upon the clamp mounting portion. The corner clamp has a body seated on the clamp mounting portion and a pair of jaw members movable mounted on opposite sides of a guide channel in the central portion thereof and aligned with the support portion of the base member. The jaw members are movable at right angles to each other and relative to cooperating fixed clamp faces on the central portion. The movable clamp members have faces which are disposed at an angle of 45° to the guide channel and parallel to the clamp faces.

The corner clamp and the base member support portion are cooperatively configured and dimensioned to provide coplanar support surfaces to seat workpieces disposed between the fixed clamp faces and movable jaw members, and the corner clamp and base member have cooperating means thereon to position the corner clamp in a predetermined position on the base member. Detachable means secures the corner clamp in the predetermined position upon the base member.

Preferably, the mitre box includes a pair of guide posts mounted on the base member and saw guide means slidably carried on the support posts to carry an associated saw with its cutting edge in alignment with the guide channel in the corner clamp.

In the preferred embodiment, the base member work support portion includes an upstanding platform element having its upper surface substantially coplanar with the support surfaces of the corner clamp jaw portions, and the platform element desirably includes an upwardly opening channel therein aligned with the guide channel of the corner clamp.

The cooperating locating means on the corner clamp and base member is conveniently provided by a pair of projections on one of the members and a pair of complementary recesses on the other of the members to receive the projections and effect the desired alignment. Preferably, one of the recesses is elongated in a direction perpendicular to the guide channel to accommodate variations in dimensions between the members.

The detachable securing means is conveniently provided by threaded fasteners. The base member desirably has a work support portion of generally elongated rectangular configuration with the clamp mounting portion having sides which diverge therefrom to provide an enlarged clamp mounting surface. Preferably, the base member is integrally molded from a synthetic resin and its lower surface has a multiplicity of intersecting ribs which provide enhanced rigidity. The projections of the locating means may conveniently provide part of the means to space the body of the corner clamp upwardly from the upper surface of the clamp mounting portion to provide the desired coplanar orientation of the clamp upper support surface with the support surface of the base member.

BRIEF DESCRIPTION OF THE DRAWINGS

FIG. 7 is a plan view of the mitre box of FIG. 1 drawn to an enlarged scale;

FIG. 8 is a fragmentary elevational view along the line 8—8 of FIG. 3 of the corner clamp showing the saw guide slot therein and drawn to an enlarged scale; and FIG. 9 is a sectional view of the base member along the line 9—9 of FIG. 7 and with the corner clamp removed.

DETAILED DESCRIPTION OF THE ILLUSTRATED EMBODIMENT

Figure 1:
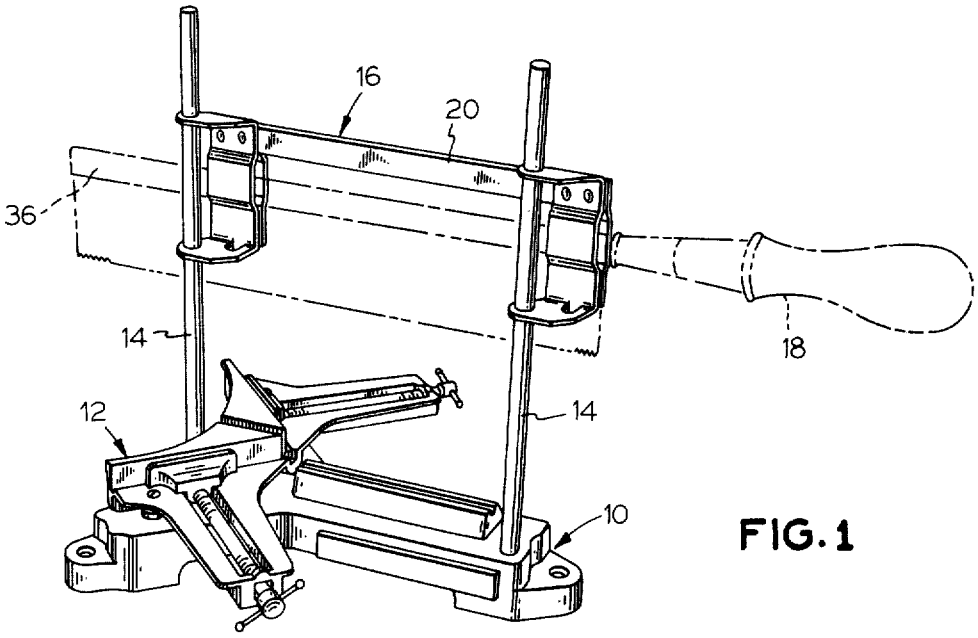
FIG. 1 is a perspective view of a mitre box embodying the present invention with the associated back saw shown in phantom line.

Turning in detail first to FIG. 1, therein illustrated is a mitre box embodying the present invention and having a base member generally designated by the numeral 10, a removable corner clamp generally designated by the numeral 12, a pair of spaced vertical guide posts 14 mounted on the base member 10, and the saw guide assembly carried thereby and generally designated by the numeral 16. As is conventional, the back saw 18, which is illustrated in phantom line in FIG. 1, is clamped in the saw guide assembly 16 for reciprocal movement horizontally therein and movement therewith vertically on the guide posts 14.

Figure 2:
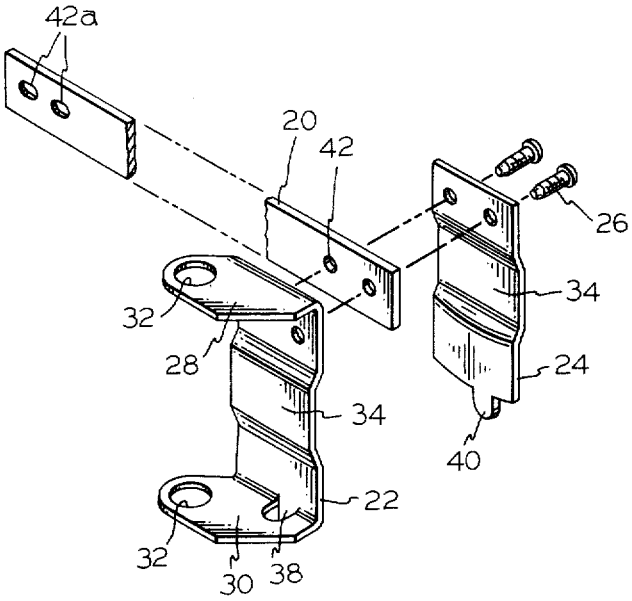
FIG. 2 is an exploded view of the fragmentarily illustrated cross bar and of the saw guide clamping elements at one end of the saw guide assembly, and drawn to an enlarged scale.
Figure 3:
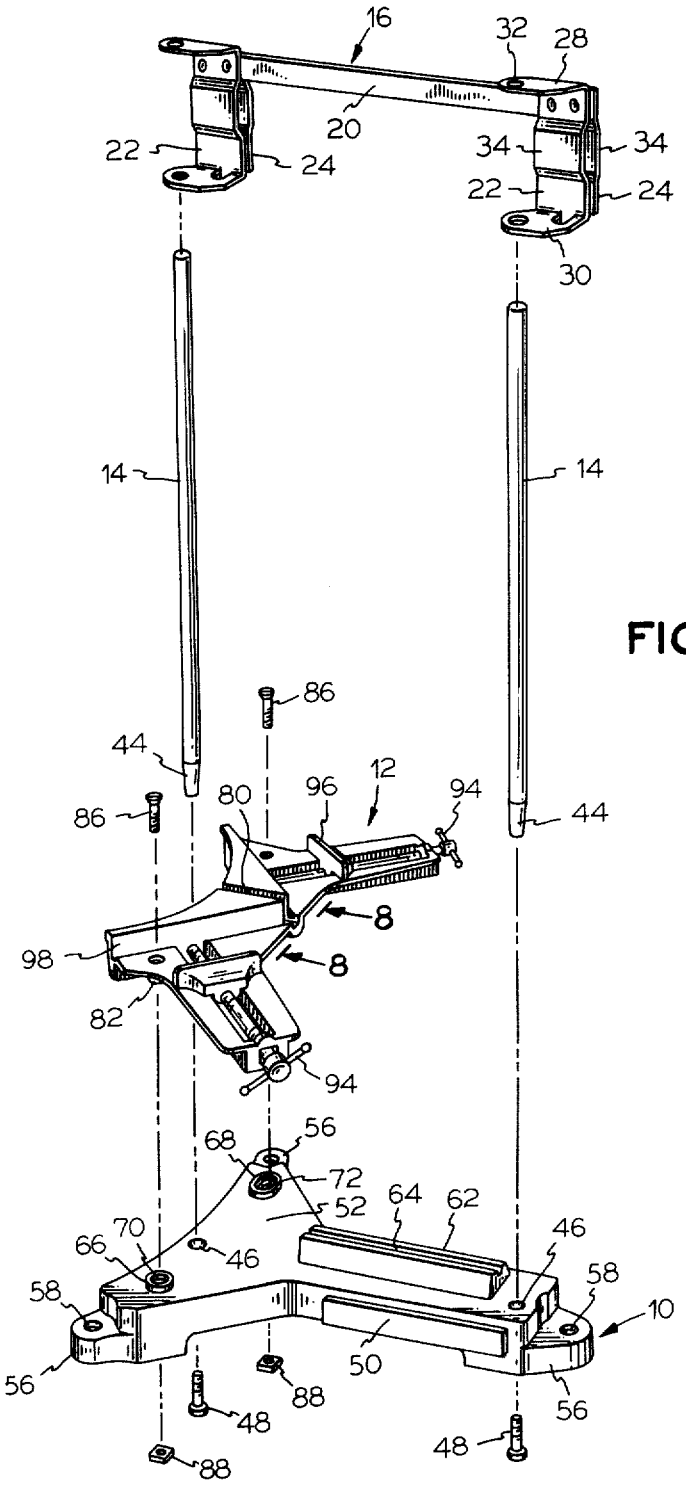
FIG. 3 is a partially exploded perspective view of the mitre box of FIG. 1, drawn to an enlarged scale.

Turning now to FIGS. 2 and 3, it can be seen that the saw guide assembly 16 is comprised of the elongated crossbar 20, which has at its ends the cooperating pairs of clamping members, each of which is provided by the saw guide 22 and the saw guide plate 24, secured adjacent their upper ends on opposite sides of the crossbar 20 by the self-tapping screws 26. The saw guide 22 has laterally extending flanges 28,30 at its top and bottom ends, the flanges 28,30 have aligned apertures 32 therein to snugly but slidably seat the saw guide assembly 16 on the posts 14. Intermediate their length and below the crossbar 20, the saw guide 22 and saw guide plate 24 are bent to provide opposed U-shaped portions 34 which are cooperatively configured to provide a channel which will snugly seat the back 36 of the back saw 18 as seen in FIG. 1. The portion of the saw guide plate 24 below the U-shaped portion 34 is inwardly bowed to provide spring-like clamping action which is enhanced by the depending finger portions 38,40 on the saw guide 22 and the saw guide plate 24.

As best seen in FIG. 2, the crossbar 20 has mounting apertures **42,42*a* through which the mounting screws 26 pass, and the apertures 42*a*** are elongated to provide some dimensional tolerance, which is particularly useful for accommodating differential expansion and contraction of components of the assembly and minimizing unnecessary stresses.

Figure 5:
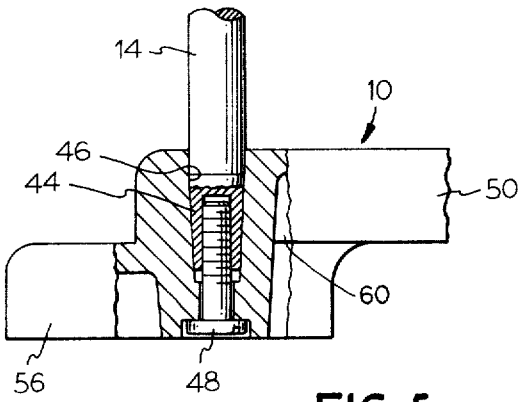
FIG. 5 is a fragmentary sectional view along the line 5—5 of FIG. 7 showing the lower portion of a guide post as mounted in the base member.

As seen in FIGS. 3 and 5, the saw guide posts 14 have tapered bottom end portions 44 which seat in upwardly opening recesses 46 in the base member 10 and which have threaded bores in their ends for engagement with the mounting screws 48 which extend upwardly through the base member 10.

Turning now in detail to the base member 10, it is configured with an elongated guide portion 50 of generally elongated rectangular configuration and a clamp mounting portion 52 with sides which diverge from the guide portion 50. The base member 10 is integrally molded with mounting feet 56 at the outer end of the guide portion 50 and at the outer ends of the clamp mounting portion 52. These feet 56 elevate the body of the base member 10 above a support surface (not shown), and apertures 58 in the feet 56 permit the base member 10, and thereby the mitre box, to be mounted securely on a support surface such as a workbench (not shown) by screws or other fasteners (not shown). As best seen in FIGS. 5 and 9, the base member 10 is desirably molded with an interconnecting series of ribs 60 on its bottom surface so as to provide strength while minimizing the amount of material needed for the desired rigidity.

On the guide portion 50 is an elevated platform portion 62 with an upwardly opening channel 64 therein disposed to intersect the clamp mounting portion 52. As seen in FIGS. 1, 3 and 5, the recesses 46 in the base member 10 for receiving the guide posts 14 are disposed to one side of the imaginary line defined by the channel 64, and the mounting flanges 28,30 of the saw guides 22 serve to align the cutting edge of the saw 18 therewith.

Figure 6:
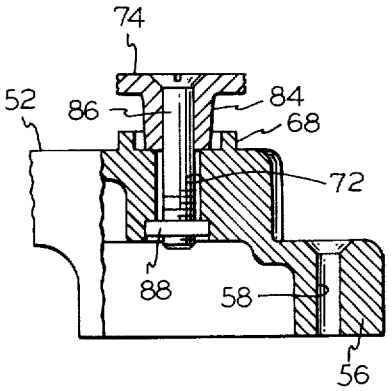
FIG. 6 is a fragmentary sectional view along the line 6—6 of FIG. 7 showing the elongated slot and mounting screw assembly for one side of the corner clamp.

As seen in FIGS. 3 and 9, the clamp mounting portion 52 has a generally planar upper surface with two upstanding bosses 66,68 diposed along a line perpendicular to the imaginary line extended from the channel 64 of the platform portion 62. The boss 66 is of annular configuration providing a cylindrical recess and the base member 10 has a cylindrical aperture 70 of smaller diameter extending perpendicularly therethrough in alignment therewith. As seen in FIGS. 3 and 6, the boss 68 is of oval configuration with its elongated axis disposed along the perpendicular line to provide an oval recess, and the base member 10 has an oval slot 72 of smaller dimensions extending therethrough aligned with the oval recess.

Turning now in detail to the corner clamp 12, the body 74 is integrally formed with arm portions 76 extending at right angles to each other on opposite sides of the central portion 78 which has an upwardly opening channel or slot 80 extending therethrough in alignment with the channel 64 of the platform portion 62. Depending from the body 74 are a pair of generally annular bosses 82,84 which seat in the upstanding bosses 66,68 of the base member 10 to position and align the corner clamp 12 upon the base member 10. Threaded fasteners 86 extend coaxially through apertures in the body 74 and into the apertures 70,72 of the base member 10, and nuts 88 thereon releasably and firmly secure the clamp 12 to the base member 10.

Figure 4:
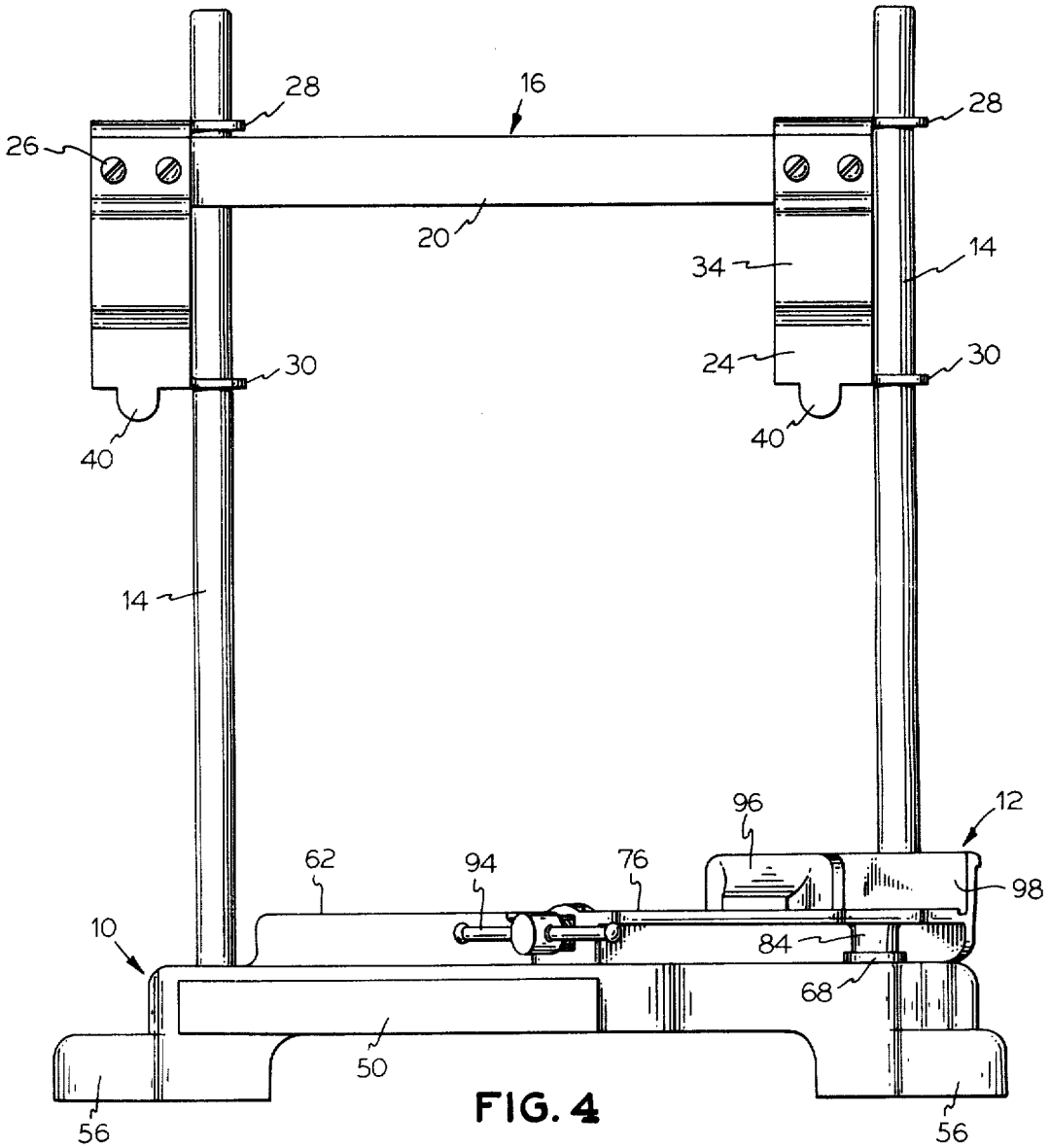
FIG. 4 is a side elevational view of the mitre box of FIG. 1 drawn to an enlarged scale.

The arm portions 76 have elongated, upwardly opening recesses 90 therein and apertures in the end walls thereof through which extend the jaw screws 92. As is conventional, handles 94 at one end of the screws 92 effect rotation thereof and move the movable jaws 96 relative to the upwardly extending clamp faces 98 provided on the central portion 78. As seen in FIG. 4, the upper surface of the arm portions 76 and of the central portion 78 forwardly of the clamp faces 98 is coplanar with the upper surface of the platform portion 62 so that workpieces (not shown) may be stably seated on the platform portion 62 and corner clamp 12 and held firmly by the clamping jaws 96 against the fixed clamp faces 98.

In operation of the mitre box of the illustrated embodiment, the back 36 of the back saw 18 is inserted into channel defined by the U-shaped portions 34 of the saw guide 22 and saw guide plate 24, and its blade is received between the lower portions thereof but is free to slide back and forth therebetween. The workpiece (not shown) is placed between a movable jaw 96 and a fixed clamp face 98 with its end extending the desired length beyond the channel 80 and onto the platform 62. The handle 94 is rotated to move the clamping jaw 96 toward the clamp face 98 and clamp the workpiece firmly in position. The back saw 18 is then moved downwardly by moving the saw guide assembly 16 downwardly on the guide posts 14 and the saw 18 is reciprocated to cut through the workpiece and provide the desired 45° angle thereon. As will be appreciated, the cutting teeth of the saw 18 are provided clearance to avoid damage to mitre box or saw teeth as they cut through the workpiece by reason of the channel 64 in the platform 62 and the saw guide channel 80 in the corner clamp 12.

After this operation has been completed, the workpiece may be removed or merely backed away from the platform portion 62 to permit the cooperating workpiece (not shown) to be inserted into the other side of the corner clamp 12 and similarly cut. After it has been cut to the complementary angle, it is backed off and the ends of the two workpieces are butted together after application of adhesive to one or both surfaces. The clamping jaws are tightened to hold the two workpieces tightly together while the joint is formed. Thus, it can be seen that the mitre box provides a good stable assembly for securing the mating pieces together after they have been cut. Afterwards, the workpiece assembly may be removed.

Alternatively, the corner clamp 12 may be removed from the base member 10 by withdrawing the fasteners 86 and lifting it from the base member 10. In this fashion, a series of corner clamps may be used to join simultaneously a series of corner elements.

Although the base member may be cast or machined from any suitable metal alloy, the illustrated construction has proven advantageous in permitting the base member to be integrally molded from synthetic resin such as acrylonitrile/butadiene/styrene interpolymer with the stiffening ribs on the bottom surface minimizing the amount of material required while providing the desired rigidity. Alternatively, more expensive resins such as polyamides, polycarbonates and acetals may be employed.

The corner clamp is preferably fabricated from metal such as steel to provide the desired strength and wear characteristics although engineering grade resins may also be employed. The guide posts are conventionally fabricated from a steel alloy which may be plated to provide the desired appearance and wear characteristics. The elements of the saw guide assembly should be fabricated from tempered steel to provide good wear characteristics and the spring clamping action on the saw and on the guide posts.

As will be appreciated, the elongated recess for the depending boss at one side of the corner clamp will accommodate differential expansion and contraction between the resin base and the metal corner clamp. Similarly, the elongated apertures at one end of the cross bar will accommodate any variations in the dimensioning of the assembly between the guide posts.

Thus, it can been seen that the mitre box of the present invention is one which is readily fabricated and assembled to provide a single and relatively rugged assembly, particularly useful for making frame members and the like which are to be joined at 90° angles to each other. The corner clamp and base member may be used in combination for the assembly of the cut workpieces or the corner clamp may be readily removed for use apart from the base member to permit multiple corner assembly when so desired.

Having thus described the invention, I claim:

1. A mitre box with a removable corner clamp comprising:

A. a base member having an upper surface including a work support portion and a clamp mounting portion;

B. a corner clamp including a body seated on said clamp mounting portion and a pair of jaw members movably mounted on opposite sides of a guide channel in the central portion thereof aligned with said work support portion of said base member, said jaw members being movable at right angles to each other and relative to cooperating fixed clamp faces on said central portion, said movable jaw members being disposed at an angle of 45° to said guide channel and parallel to said fixed clamp faces, said corner clamp and said base member support portion being cooperatively configured and dimensioned to provide coplanar support surfaces to seat workpieces disposed between the fixed clamp faces and movable jaw members, said corner clamp and base member having cooperating means thereon for positioning said corner clamp in a predetermined position on said base member; and C. means detachably securing said corner clamp body upon the upper surface of said base member, with said work support portion of said base member extending longitudinally in alignment with said guide channel and having its upper surface substantially coplanar with said support surface of said clamp.

2. The mitre box in accordance with claim 1 wherein there is included a pair of guide posts mounted on said base member outwardly of said corner clamp; and saw guide means slidably carried on said guide posts and adapted to carry an associated saw with its cutting edge in alignment with said guide channel in said corner clamp.

3. The mitre box in accordance with claim 1 wherein said base member work support portion includes an upstanding platform element providing the upper surface thereof substantially coplanar with said support surface of said corner clamp.

4. The mitre box in accordance with claim 1 wherein said platform element of said base member work portion has an upwardly opening channel therein aligned with said guide channel of said corner clamp.

5. The mitre box in accordance with claim 1 wherein said cooperating positioning means on said corner clamp and base member comprises a pair of projections extending from the adjacent surface of one of said members and cooperating recesses on the other of said members receiving said projections.

6. The mitre box in accordance with claim 4 wherein one of said cooperating recesses is elongated in a direction perpendicular to said guide channel to accommodate variations in dimension between said members.

7. The mitre box in accordance with claim 1 wherein said detachable securing means comprises threaded fasteners.

8. The mitre box in accordance with claim 1 wherein said portion of said base member providing said work support portion is of generally elongated rectangular configuration and said clamp mounting portion thereof has sides which diverge therefrom to provide an enlarged clamp mounting surface.

9. The mitre box in accordance with claim 1 wherein said base member is integrally molded from synthetic resin and has a multiplicity of intersecting ribs on its lower surface providing enhanced rigidity.

10. The mitre box in accordance with claim 5 wherein said projections space the lower surface of said body of said corner clamp upwardly from the upper surface of said clamp mounting portion to provide the desired coplanar orientation of the work support surfaces.

* * * * *